US005190584A

United States Patent [19]

Ruffini

[11] Patent Number: 5,190,584

[45] **Date of Patent: * Mar. 2, 1993**

[54] KETENE DIMER PAPER SIZING AGENTS MODIFIED BY NONREACTIVE HYDROPHOBES

[75] Inventor: Guglielmo Ruffini, Bergamo, Italy

[73] Assignee: Hercules Incorporated, Wilmington, Del.

[ * ] Notice: The portion of the term of this patent subsequent to Apr. 24, 2007 has been disclaimed.

[21] Appl. No.: 627,944

[22] Filed: Dec. 13, 1990

[30] Foreign Application Priority Data

Dec. 14, 1989 [IT] Italy ..... 89/22701A

[51] Int. Cl.[5] ..... C09D 7/12

[52] U.S. Cl. ..... 106/243; 106/171; 106/211; 162/179

[58] Field of Search ..... 106/243, 171, 211; 162/179

[56] References Cited

U.S. PATENT DOCUMENTS

| | | | |
|---|---|---|---|
| 2,785,067 | 3/1957 | Osberg | 162/179 |
| 3,311,532 | 3/1967 | Kulick et al. | 162/179 |
| 4,859,244 | 8/1989 | Floyd | 162/179 |
| 4,919,724 | 4/1990 | Cenisio et al. | 106/211 |

*Primary Examiner*—Theodore Morris
*Assistant Examiner*—David M. Brunsman
*Attorney, Agent, or Firm*—Ivan G. Szanto; Roy V. Jackson

[57] ABSTRACT

Compositions of ketene dimer and nonreactive hydrophobe compound and method for internally sizing paper therewith are provided, wherein the melting point of said hydrophobe compound is higher than the melting point of the ketene dimer.

12 Claims, No Drawings

KETENE DIMER PAPER SIZING AGENTS MODIFIED BY NONREACTIVE HYDROPHOBES

BACKGROUND OF THE INVENTION

1. Field of the Invention

The present invention relates to compositions for the internal sizing of paper and, more particularly, it relates to ketene dimer/nonreactive hydrophobe compounds providing improved sizing results.

2. Description of the Prior Art

The main component of paper and paperboard is cellulose fiber. The flat web of cellulose fibers may contain inorganic fillers, starch, pigments and other papermaking adjuvants. Such paper and paperboard would readily absorb aqueous liquids. This property would be a serious disadvantage when the paper is used in printing or coating or pasting operations. Also, most papermaking machines apply a surface coating to the semidried paper using an aqueous coating mix at a size press. The application of a surface coating to a paper or board as above is technically difficult, especially at the lighter weights of paper.

These technical difficulties have been overcome by sizing the paper and paperboard. Sizing agents are used to impart to the paper and paperboard resistance to aqueous penetrants. Various types of sizing agents have been used commercially over many years. Most end use applications for the paper require that the paper is sized internally—that is the sizing agent is added to the paper components before the paper web is formed.

Ketene dimer sizing agents were introduced to the paper industry in the late 1950's and early 1960's. These allowed for the first time the production of internally sized paper and paperboard under neutral to alkaline pH conditions. Traditionally clay had been used as the filler but now chalk could be used within the neutral/alkaline papermaking conditions. Paper and paperboard made under these conditions has many commercial advantages, and the use of ketene dimer sizing agents has now spread throughout the worldwide papermaking industry. Ketene dimers are water insoluble products and they are used largely in the form of aqueous dispersions which are added to the papermaking stock.

After the wet web of paper has been formed on the papermaking machine it is dried by passing around a series of heated cylinders. This period of heating and drying promotes a chemical reaction between the ketene dimer and the hydroxyl groups on the cellulose fiber, possibly also with hydroxyl groups on the fillers. This chemical reaction is time and temperature dependent. On some papermaking machines the duration of heating is sufficient to promote the chemical reaction to such an extent that a sizing effect results on the machine. This, however, is not the case on most papermaking machines since they are operated at maximum speed to optimize paper production and this reduces the period of the heating and drying. Consequently most papermaking machines using ketene dimer sizing agents alone do not make sized paper on-machine. This detracts from the operation of the size press. The chemical reaction between dimer and hydroxyl groups does continue in the dried paper but it may take several days to reach naturally its full sizing development. This slow development of sizing creates problems with the conduct of further operations such as printing, coating, pasting, etc.

This problem of the slow development of sizing with ketene dimers alone has received considerable attention over the years. A solution used commercially since the early 1970's has been to employ a promoter resin with the ketene dimer. Promoter resins of dicyandiamide/-formaldehyde condensates have been used successfully to speed up the development of sizing. Another potential solution is to employ with the ketene dimer another sizing agent which will give an immediate effect on-machine. One such additional sizing agent is wax as proposed in Japanese Patent J58 087395. Others such as pentaerythritol aliphatic acid esters, polyalkylene glycol di-aliphatic acid esters, mono-and/or di-fatty acid esters of alkane diols, polyvalent metal salts of fatty acids, fatty cane sugar esters and polyalkylene glycol mono-fatty acid esters have been proposed in Japanese Patents J58 091895, J58 091894, J58 087396, J57 112499, J57 101096 and J57 101095 respectively.

Japanese Patent J57 112498 proposes the use of mixtures of ketene dimers with di- and/or triglycerides as being sizing agents that can be used in neutral and alkaline conditions and which give a sizing effect in a short time. The appropriate amounts to use are 5–100 parts of glyceride, preferably 10–50 parts of glyceride, relative to 100 parts of ketene dimer to give degrees of sizing in a short time of approximately 50–68 percent of the degree of natural cure after one day. The use of these mixed size systems does not increase the level of sizing after one day above that achieved by the use of ketene dimer alone.

A further disadvantage of a ketene dimer sizing agent is that it can react with water to yield and ineffective ketone. This action reduces the efficiency of the sizing agent.

The object of the present invention is to provide a sizing agent that includes the use of a ketene dimer within its composition that sizes paper and paperboard within a short time and improves the efficiency of the ketene dimer.

SUMMARY OF THE INVENTION

According to the present invention, there is provided a composition comprising (a) ketene dimer having the general formula $$[RCH{=}C{=}O]_2$$

wherein R is an alkyl radical having from 6 to 22 carbon atoms, a cycloalkyl radical having at least 6 carbon atoms, an aryl, aralkyl or alkaryl radical, and (b) nonreactive hydrophobe compound, provided, however, that the melting point of said nonreactive hydrophobe is higher than the melting point of said ketene dimer and the ketene dimer to hydrophobe ratio is from about 1:100 to about 99:100 by weight.

Further provided according to the present invention is a process of sizing paper internally by adding to the papermaking stock the composition of the present invention.

Still further provided according to the present invention is paper sized internally with the composition of the present invention.

DETAILED DESCRIPTION OF THE INVENTION

It has surprisingly been found that a composition of ketene dimer and nonreactive hydrophobe compound, wherein the melting point of the hydrophobe compound is higher than the melting point of the ketene dimer, results in the sizing of paper and paperboard within a short time and the efficiency of the ketene dimer is also improved by such combination which is a fatty acid ester derived from fatty acids having from 10 to 24 carbon atoms and alcohols having from 1 to 5 carbon atoms selected from the group consisting of mono-, di- and polyhydric alcohols, the melting point of said fatty acid ester is at least about 10° C. higher than the melting point of said ketene dimer, and the ketene dimer to fatty acid ester ratio is from about 11:100 to about 75:100 by weight.

The ketene dimers (KD's) which may be used as components of the present composition may be any of the known KD's having the general formula $$[RCH{=}C{=}O]_2$$

wherein R is an alkyl radical which may be saturated or unsaturated having from 6 to 22 carbon atoms preferably from 10 to 20 carbon atoms and most preferably from 14 to 16 carbon atoms; a cycloalkyl radical having at least 6 carbon atoms or an aryl, aralkyl or alkaryl radical. These known KD's are as described in U.S. Pat. 2,785,067. The KD may be a single species or may contain a mixture of species.

Suitable KD's include decyl, dodecyl, tetradecyl, hexadecyl, octadecyl, eicosyl, docosyl, tetracosyl cyclohexyl, phenyl and benzyl-$\beta$-napthyl ketene dimers, as well as KD's prepared from palmitoleic acid, oleic acid, ricinoleic acid, linoleic acid, linolenic acid, myristoleic acid and eleostearic acid or mixtures thereof.

According to a preferable embodiment of the present invention, the nonreactive hydrophobe compound is fatty acid ester which can be natural or synthetic, saturated or unsaturated or mixtures thereof. They are based on C10–C24 fatty acids, preferably C14–C22 saturated fatty acids and most preferably C16–C18 saturated fatty acids. The esterification may be achieved by use of mono-, or di- or polyhydric alcohols having from 1 to 5 C atoms to yield monoesters, diesters, or polyesters, respectively. Included in the polyesters are the triglycerides which may be natural or synthetic in origin. Preferably the esterification is carried out by use of C2 to C5 di- and polyhydric alcohols, and most preferably C3 trihydric alcohol (glycerol).

The benefits of this invention are gained when the ketene dimer is blended with the hydrophobe in a ratio of from about 1 to about 99 parts by weight of dimer to about 100 parts of hydrophobe. More beneficial is a ratio of from about 5 to about 75 parts of ketene dimer to about 100 parts of hydrophobe. The most preferred ratio is from about 11 to about 50 parts of dimer to about 100 parts of hydrophobe.

When selecting the type of ketene dimer and the type of nonreactive hydrophobe to work together in this invention it is necessary to ensure that the melting point of the selected nonreactive hydrophobe is above that of the selected dimer, preferably at least about 10° C. higher, and most preferably at least about 20° C. higher than the melting point of the dimer.

Conventionally, ketene dimers have been made into stable, aqueous dispersions with particle sizes in the approximate region of 1–5 microns using conventional cationic or anionic or nonionic dispersing agents. Suitable stabilizers are e.g. starch, cationic starch, anionic starch, amphoteric starch, water soluble cellulose ethers, polyacrylamides, polyvinyl alcohol, polyvinyl pyrrolidone (PVP) or mixtures thereof. It is to be expected that any stabilizer known in the art will be suitable in some of the applications envisaged. Preferred stabilizers are starch, cationic starch and PVP and the most preferred stabilizers are the cationic starches. The amount of stabilizer used will depend on the solids content of the dispersion necessary for any particular application, but can be readily determined by routine experiment by a person skilled in the art. Generally the stabilizer will be present in an amount of from about 1 to about 30% based on the weight of KD/hydrophobe, preferably from about 3 to about 20% and most preferably from about 5 to about 10%.

The dispersion of the present invention may also include other additives commercially used in the art, such as promoter resins for the KD's, biocides, etc.

Stable aqueous dispersions of the nonreactive hydrophobes may be made by conventional means as outlined above for the ketene dimer dispersion.

It is a requirement of this invention that the ketene dimer and the nonreactive hydrophobe be brought together in a particular manner such that the objects of this invention are achieved. This has been achieved by the following methods which are not limiting. The hydrophobe and the ketene dimer can be melted and blended together prior to being made into an aqueous dispersion by conventional means. Alternatively, a hot, aqueous dispersion of the ketene dimer can be mixed with a hot, aqueous dispersion of the hydrophobe. The resultant blended aqueous dispersion is used at ambient temperatures. The benefits of this invention are not gained if these two dispersions are mixed when at ambient temperatures, nor are the benefits gained if the two dispersions are added separately to the paper stock.

Japanese patent 57 112498 uses dispersions of ketene dimer and di- and/or triglycerides of fatty acids at ratios of 5–100 parts of ester to 100 parts of ketene dimer. Table 3 of this Japanese patent shows that the improvement obtained in sizing shortly after papermaking reaches a maximum at a ratio of 20 parts ester to 100 parts dimer. Higher ratios of ester to dimer caused a slight reduction in sizing obtained shortly after papermaking. Similarly the level of sizing obtained after one day reaches a maximum at the ratio of 20 parts of ester to 100 parts of dimer and thereafter decreases slightly at higher ratios.

It was surprisingly and unexpectedly found that the sizing effect obtained within a short time after papermaking with the compositions of the present invention was far greater than those obtained in Japanese Patent 57 112478 and the sizing effect obtained after one day was far higher than was being obtained using ketene dimer alone.

The actual amount of solids present in the dispersion may vary from about 3 to about 50% by weight, preferably from about 4 to about 40%, and most preferably from about 5 to about 35%.

Generally, the amount of sizing composition applied should be sufficient to result in paper having from about 0.01 to about 1% of ketene dimer based on the weight of dry paper.

Preferably, the sizing composition should result in from about 0.02 to about 0.6 and, most preferably, from about 0.04 to about 0.4% of ketene dimer based on the weight of dry paper.

This invention is illustrated by the following examples but is not limited by them. All parts and percentages are by weight unless otherwise specified.

The degree of sizing is measured by either a 1 minute Cobb Test using water (which is a standard internationally recognized test) or by the Hercules Sizing Test (H.S.T.). The Cobb Test measures water absorbed and higher sizing is shown by lower Cobb values.

In the HST, a sheet of sized paper is laid onto a solution containing by weight 1% of formic acid and 1.2% of Naphthol Green B. The reflectance of the paper is measured initially and is then monitored as it falls due to ink penetration into the paper. The HST time (in seconds) is the time taken for the reflectance to fall to 80% of its initial value. It can thus be seen that the larger the HST value, the better is the sizing.

EXAMPLES 1 TO 4 AND COMPARATIVE EXAMPLE 1

Glycerol tristearate/ketene dimer mixtures (made from a mixed feed of palmitic/stearic acids) having ratios of 0:1, 2:1, 3:1, 5:1 and 9:1 were prepared by melting and blending the two components. These mixtures were dispersed in aqueous dispersions of a waxy maize cationic starch having a degree of substitution of 0.035. These dispersions were added separately to paper stock consisting of 30 percent groundwood pulp, 35 percent hardwood pulp and 35 percent softwood pulp. The paper stock was used to make 65 grams per square meter (G.S.M.) paper sheets that were dried on a rotary cylinder drier. The sizing level of each sheet was determined by Cobb Test and by H.S.T. immediately off-drier and after one day of natural curing.

| | ADDITION | | SIZING | | | |
|---|---|---|---|---|---|---|
| | | | Off-Drier | | Natural 1 Day | |
| Ex. No. | Glycerol Tristearate Percent[1] | Ketene Dimer Percent[1] | Cobb G.S.M. | H.S.T. Seconds | Cobb G.S.M. | H.S.T. Seconds |
| C-1 | — | 0.240 | 54 | 10 | 18.3 | 441 |
| 1 | 0.240 | 0.120 | 59 | 18 | 20.4 | 204 |
| 2 | 0.359 | 0.120 | 47 | 24 | 19.9 | 284 |
| 3 | 0.600 | 0.120 | 40 | 92 | 19.6 | 295 |
| 4 | 1.079 | 0.120 | 19 | 403 | 17.3 | 647 |

[1]Wt. % based upon weight of dried paper

These results show that the conjoint use of glycerol tristearate with 0.120 percent ketene dimer can result in:

(A) greatly improved off-drier sizing compared with the sizing of 0.240 percent ketene dimer alone;

(B) a level of sizing off-drier that is nearly 100 percent of the level of one day natural cured sizing achieved with 0.240 percent ketene dimer alone; and (C) far higher levels of one day natural cured sizing compared with the one day natural cured sizing of 0.240 percent ketene dimer alone.

EXAMPLES 5 TO 8 AND COMPARATIVE EXAMPLE 2

Example 1 was repeated using a potato cationic starch having a degree of substitution of 0.043 and the following results were obtained:

| | ADDITION | | SIZING H.S.T. SECONDS | |
|---|---|---|---|---|
| Ex. No. | Glycerol Tristearate Percent | Ketene Dimer Percent | Off-Drier | Natural 1 Day |
| C-2 | — | 0.18 | 42.0 | 325.0 |
| 5 | 0.225 | 0.045 | 116.0 | 288.0 |
| 6 | 0.225 | 0.09 | 191.0 | 426.0 |
| 7 | 0.30 | 0.09 | 219.0 | 363.5 |
| 8 | 0.45 | 0.09 | 227.5 | 394.0 |

This experiment shows again that the conjoint use of glycerol tristearate with a ketene dimer can greatly increase the off-drier sizing and can increase the level of one day natural cured sizing compared with the off-drier and one day natural cured sizing achieved with twice the added amount of ketene dimer alone.

EXAMPLE 9 AND COMPARATIVE EXAMPLE 3

500 g. of a hot dispersion containing 15 g. of a ketene dimer prepared from mixed palmitic/stearic acids, 15 g. of a waxy maize cationic starch having a degree of substitution of 0.035 and 0.35 g. of sodium lignin sulphonate were prepared. This was repeated using 75 g. of glycerol tristearate in place of the 15 g. of ketene dimer.

These two hot dispersions were mixed. The mixture was cooled and acidified to pH 4.3.

This mixture was tested in a paper system of 35 percent groundwood pulp and 65 percent cellulose pulp with the following results:

| | ADDITION | | SIZING H.S.T. SECONDS | |
|---|---|---|---|---|
| Ex. No. | Glycerol Tristearate Percent | Ketene Dimer Percent | Off-Drier | Natural 1 Day |
| C-3 | — | 0.18 | 54.1 | 305.0 |
| 9 | 0.225 | 0.045 | 170.0 | 310.0 |

These results show that the conjoint use of glycerol tristearate with 0.045 percent ketene dimer results in greatly improved off-drier sizing compared with the use of 0.18 percent ketene dimer alone.

EXAMPLE 10

Following the procedure of Example 1, glycerol tristearate and ketene dimer were melted and blended in the amounts indicated in the Table below. These mixtures were stabilized in POLYMIN SK, an aqueous solution of highly cationic polyethyleneimine having a total solids of 25% by weight sold by BASF, to yield stable aqueous dispersions. These dispersions were tested as in Example 1 and the results are summarized in the following Table.

| Ex. No. | Glycerol Tristearate Percent | Ketene Dimer Percent | Off Drier HST-Seconds | Natural 1 Day HST-Seconds |
|---|---|---|---|---|
| C-4 | — | 0.3 | 105 | 428 |
| 10 | 0.55 | 0.05 | 838 | 1200 |
| C-5 | — | 0.18 | 65 | 313 |
| 11 | 0.3 | 0.06 | 116 | 393 |

These results show again that the conjoint use of glycerol tristearate and ketene dimer in the manner of this invention results in higher levels of sizing, both off-drier and after natural curing for 1 day, when compared with the levels of sizing achieved with far larger amounts of ketene dimer alone.

This example also shows that the effects and benefits of this invention are independent of the stabilizing system used. It is necessary to make stable dispersion but this may be achieved by the use of conventional products and techniques.

I claim:

1. A composition comprising (a) a ketene dimer having the general formula $[RCH{=}C{=}O]_2$ wherein R is an alkyl radical having from 6 to 22 carbon atoms, a cycloalkyl radical having at least 6 carbon atoms, an aryl, aralkyl or alkaryl radical, and (b) a nonreactive hydrophobe compound, which is a fatty acid ester derived from fatty acids having from 10 to 24 carbon atoms and alcohols having from 1 to 5 carbon atoms selected from the group consisting of mono-, di- and polyhydric alcohols, the melting point of said fatty acid ester is at least about 10° C. higher than the melting point of said ketene dimer, and the ketene dimer to fatty acid ester ratio is from about 11:100 to about 75:100 by weight.

2. The composition of claim 1 wherein the ketene dimer is selected from dimers wherein R is an alkyl radical having from 10 to 20 carbon atoms and mixtures thereof.

3. The composition of claim 2 wherein the ketene dimer is selected from dimers wherein R is an alkyl radical having from 14 to 16 carbon atoms and mixtures thereof, the fatty acid ester is derived from saturated fatty acids having from 16 to 18 carbon atoms and trihydric alcohol having 3 carbon atoms, the melting point of said fatty acid ester is at least about 20° C. higher than the melting point of said ketene dimer, and the ketene dimer to fatty acid ester ratio is from about 11:100 to about 50:100 by weight.

4. The composition of claim 1 containing from about 1 to about 30% of stabilizer based on the weight of ketene dimer/nonreactive hydrophobe.

5. The composition of claim 4 wherein the ketene dimer is selected from dimers wherein R is an alkyl radical having from 10 to 20 carbon atoms and mixtures thereof, the nonreactive hydrophobe is fatty acid ester derived from fatty acids having from 10 to 24 carbon atoms and alcohols having from 1 to 5 carbon atoms selected from the group consisting of mono-, di- and polyhydric alcohols, the stabilizer is selected from the group consisting of non-ionic starch, cationic starch, anionic starch, amphoteric starch, water soluble cellulose ethers, polyacrylamides, polyvinyl alcohol, polyvinyl pyrrolidone and mixtures thereof, the melting point of said fatty acid ester is at least about 10° C. higher than the melting point of said ketene dimer, the stabilizer level is from about 3 to about 20% based on the weight of ketene dimer/fatty acid ester.

6. The composition of claim 5 wherein the ketene dimer is selected from dimers wherein R is an alkyl radical having from 14 to 16 carbon atoms and mixtures thereof, the fatty acid ester is derived from saturated fatty acids having from 16 to 18 carbon atoms and trihydric alcohol having 3 carbon atoms, the stabilizer is selected from the group consisting of non-ionic starch, cationic starch and polyvinyl pyrrolidone, the melting point of said fatty acid ester is at least about 20° C. higher than the melting point of said ketene dimer, the stabilizer level is from about 5 to about 10% based on the weight of ketene dimer/fatty acid ester.

7. An aqueous dispersion comprising (a) a ketene dimer having the general formula wherein R is an alkyl radical having from 6 to 22 carbon atoms, a cycloalkyl radical having at least 6 carbon atoms, an aryl, aralkyl or alkaryl radical;

(b) a nonreactive hydrophobe compound, which is a fatty acid ester derived from fatty acids having from 10 to 24 carbon atoms and alcohols having from 1 to 5 carbon atoms selected from the group consisting of mono-, di- and polyhydric alcohols, the melting point of said fatty acid ester is at least about 10° C. higher than the melting point of said ketene dimer, and the ketene dimer to fatty acid ester ratio is from about 11:100 to about 75:100 by weight, and (c) water.

8. The dispersion of claim 7 wherein the ketene dimer is selected from dimers wherein R is an alkyl radical having from 10 to 20 carbon atoms and mixtures thereof.

9. The dispersion of claim 8 wherein the ketene dimer is selected from dimers wherein R is an alkyl radical having from 14 to 16 carbon atoms and mixtures thereof, the fatty acid ester is derived from saturated fatty acids having from 16 to 18 carbon atoms and trihydric alcohol having 3 carbon atoms, the melting point of said fatty acid ester is at least about 20° C. higher than the melting point of said ketene dimer, the solids content of the dispersion is from about 5 to about 35% by weight.

10. The dispersion of claim 7 containing from about 1 to about 30% of stabilizer based on the weight of ketene dimer/nonreactive hydrophobe.

11. The dispersion of claim 10 wherein the ketene dimer is selected from dimers wherein R is an alkyl radical having from 10 to 20 carbon atoms and mixtures thereof, the nonreactive hydrophobe is fatty acid ester derived from fatty acids having from 10 to 24 carbon atoms and alcohols having from 1 to 5 carbon atoms selected from the group consisting of mono-, di- and polyhydric alcohols, the stabilizer is selected from the group consisting of non-ionic starch, cationic starch, anionic starch, amphoteric starch, water soluble cellulose ethers, polyacrylamides, polyvinyl alcohol, polyvinyl pyrrolidone and mixtures thereof, the melting point of said fatty acid ester is at least about 10° C. higher than the melting point of said ketene dimer, the solids content of the dispersion is from about 4 to about 40% by weight, the stabilizer level is from about 3 to about 20% based on the weight of ketene dimer/fatty acid ester.

12. The dispersion of claim 11 wherein the ketene dimer is selected from dimers wherein R is an alkyl radical having from 14 to 16 carbon atoms and mixtures thereof, the fatty acid ester is derived from saturated fatty acids having from 16 to 18 carbon atoms and trihydric alcohol having 3 carbon atoms, the stabilizer is selected from the group consisting of non-ionic starch, cationic starch and polyvinyl pyrrolidone, the melting point of said fatty acid ester is at least about 20° C. higher than the melting point of said ketene dimer, the solids content of the dispersion is from about 5 to about 35% by weight, the stabilizer level is from about 5 to about 10% based on the weight of ketene dimer/fatty acid ester, and the ketene dimer to fatty acid ester ratio is from about 11:100 to about 50:100 by weight.

* * * * *